US007548625B2

(12) United States Patent
Dorfman et al.

(10) Patent No.: US 7,548,625 B2
(45) Date of Patent: Jun. 16, 2009

(54) SYSTEM AND METHOD OF AUDIO TESTING OF ACOUSTIC DEVICES

(75) Inventors: Boris Dorfman, Waterloo (CA); Barry S. Hazell, Nepean (CA)

(73) Assignee: Research In Motion Limited, Waterloo, Ontario (CA)

( * ) Notice: Subject to any disclaimer, the term of this patent is extended or adjusted under 35 U.S.C. 154(b) by 640 days.

(21) Appl. No.: 10/721,725

(22) Filed: Nov. 25, 2003

(65) Prior Publication Data

US 2005/0013444 A1 Jan. 20, 2005

Related U.S. Application Data

(60) Provisional application No. 60/429,531, filed on Nov. 29, 2002.

(51) Int. Cl.
*H04R 29/00* (2006.01)

(52) U.S. Cl. ..... 381/58; 455/67.11; 455/67.12; 455/67.14; 455/423; 455/424

(58) Field of Classification Search ..... 381/86, 381/58–60, 56, 122; 455/67, 67.11–67.15, 455/423–424

See application file for complete search history.

(56) References Cited

U.S. PATENT DOCUMENTS

| | | | | |
|---|---|---|---|---|
| 5,361,305 | A * | 11/1994 | Easley et al. | 381/58 |
| 5,682,134 | A | 10/1997 | Stallbohm | |
| 5,721,783 | A | 2/1998 | Anderson | |
| 5,930,703 | A * | 7/1999 | Cairns | 455/418 |
| 6,879,693 | B2 * | 4/2005 | Miller et al. | 381/60 |
| 6,950,525 | B2 * | 9/2005 | Harrell et al. | 381/59 |
| 6,957,134 | B2 * | 10/2005 | Ramseyer et al. | 701/29 |
| 7,024,161 | B1 * | 4/2006 | LaMedica, Jr. | 455/67.11 |
| 7,026,423 | B2 * | 4/2006 | Gunatillake et al. | 528/28 |
| 7,050,592 | B1 * | 5/2006 | Iseberg et al. | 381/60 |
| 7,092,531 | B2 * | 8/2006 | Enya et al. | 381/86 |
| 7,206,423 | B1 * | 4/2007 | Feng et al. | 381/312 |
| 2002/0176584 | A1 * | 11/2002 | Kates | 381/60 |
| 2003/0064746 | A1 * | 4/2003 | Rader et al. | 455/550 |
| 2003/0073408 | A1 * | 4/2003 | Harrell et al. | 455/67.1 |
| 2004/0037428 | A1 * | 2/2004 | Keller | 381/60 |

FOREIGN PATENT DOCUMENTS

| | | | |
|---|---|---|---|
| DE | 19544152 | C1 | 11/1995 |
| DE | 19612981 | A1 | 4/1996 |
| DE | 196 12 981 | A1 | 11/1996 |
| DE | 195 44 152 | C1 | 4/1997 |
| EP | 0268788 | | 10/1987 |
| EP | 0 268 788 | A2 | 6/1988 |
| WO | PCT/CA03/01852 | | 6/2004 |

* cited by examiner

*Primary Examiner*—Vivian Chin
*Assistant Examiner*—Disler Paul
(74) *Attorney, Agent, or Firm*—Ridout & Maybee LLP

(57) ABSTRACT

A system and method of testing the audio performance of an acoustic device is provided. To test a device microphone, an audio signal is generated, provided to an external speaker, outputted to the device microphone, and routed to an auxiliary input/output device where it is outputted and analyzed. To test a device speaker, an audio signal is generated, inputted to an auxiliary input/output device, routed to the device speaker, outputted to an external microphone, and outputted to an audio analyzer.

32 Claims, 3 Drawing Sheets

SYSTEM AND METHOD OF AUDIO TESTING OF ACOUSTIC DEVICES

This application claims the benefit of U.S. Provisional Application Ser. No. 60/429,531 filed Nov. 29, 2002, the entire disclosure of which is incorporated herein by reference.

BACKGROUND

1. Field of the Invention

The present invention is directed toward audio testing of acoustic devices.

2. Description of the Related Art

There are currently several ways to do audio testing of acoustic devices. One of the more common approaches involves generating a signal that is sent to a measurement speaker or artificial mouth, and is then picked up by the device microphone. The signal is looped into the device speaker, where the measurement microphone or artificial ear receives the signal and delivers the signal to the audio analyzer. There are several problems with this method. The signal is passed through four transducers, requiring four electro-acoustic conversions, resulting in distortion of the signal. Additionally, having two speakers and two microphones in one enclosure can cause cross-interference and excess noise.

A second approach, generally known as half-path testing, involves wireless communication with a base station simulator. To test the microphone, a phone call is set-up between a device being tested and the base station simulator. An audio signal is generated in an enclosure and is picked up by the device's microphone. This signal is sent to the base station simulator and measured. The signal at the base station simulator can then be compared to a set of test limits in order to evaluate the quality of the microphone path of the device. To test the speaker, an audio signal is sent by the base station to the device in a phone call. The audio signal that appears on the device speaker can be analyzed and compared to the set of test limits in order to evaluate the quality of the speaker path of the device. This method can be quite expensive, requiring either a base station or a base station simulator. This testing also introduces distortion and noise caused by the signal path from the device to the base station.

SUMMARY

A method of testing the audio performance of an acoustic device, the acoustic device comprising a device microphone and an auxiliary output device, is provided. The method comprises steps of producing an electric audio signal, providing the electric audio signal as an input to an external speaker, providing the acoustic audio signal outputted from the external speaker as an input to the device microphone, routing the electric audio signal from the device microphone to the auxiliary output device, and analyzing the electric audio signal outputted from the auxiliary output device.

A method for testing the audio performance of an acoustic device, the acoustic device comprising a device speaker and an auxiliary input device, is also provided. The method comprises steps of producing an electric audio signal, inputting the electric audio signal to the auxiliary input device, routing the electric audio signal from the auxiliary input device to the device speaker, providing the acoustic audio signal outputted by the device speaker as input to an external microphone, and analyzing the electric audio signal produced by the external microphone.

A system of audio testing an acoustic device, the acoustic device comprising a device microphone and an auxiliary input/output device, is also provided. The system comprises an audio generator, an external speaker, and an audio analyzer. The audio generator produces an audio signal, and the audio signal is provided as input to the external speaker. The audio signal is then outputted by the external speaker such that the audio signal is converted into an acoustic audio signal. The audio signal is then inputted to the device microphone. The audio signal is then routed through the acoustic device from the device microphone to the auxiliary input/output device. The audio signal then is outputted by the auxiliary input/output device and inputted to the audio analyzer. The audio analyzer then analyzes the audio signal.

A system of audio testing an acoustic device, the acoustic device comprising a device speaker and an auxiliary input/output device, is also provided. The system comprises an audio generator, an external microphone, and an audio analyzer. The audio generator produces an audio signal, and the audio signal is provided as input to the auxiliary input/output device. The audio signal is then routed from the auxiliary input/output device to the device speaker. The audio signal is then outputted by the device speaker as an acoustical audio signal which is inputted to the external microphone. The audio signal is then provided by the external microphone as input to audio analyzer, and the audio analyzer analyzes the audio signal.

DETAILED DESCRIPTION

Audio testing of acoustic devices comprises separate systems and methods of testing a microphone included in the acoustic device, and a speaker included in the acoustic device.

Figure 1:
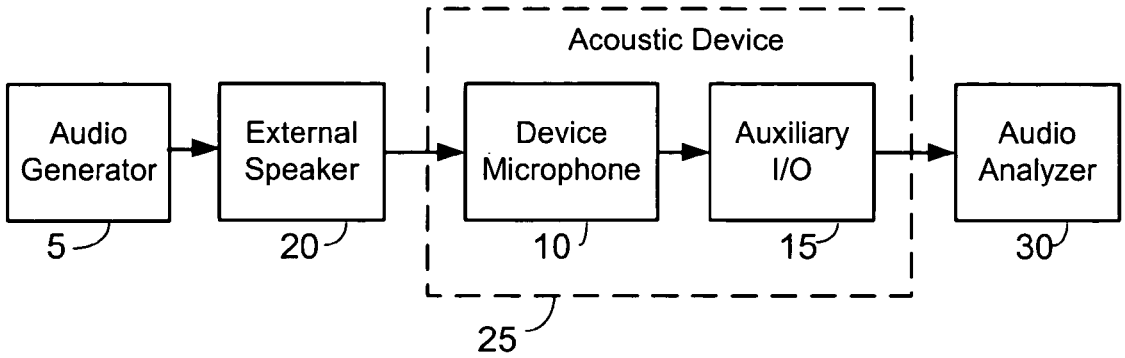
FIG. 1 is a block diagram of a system of acoustic device microphone testing.

FIG. 1 is a block diagram of a system of acoustic device microphone testing. The system includes an audio generator 5, an external speaker 20, an acoustic device 25, a device microphone 10, an auxiliary input/output (I/O) device 15 and an audio analyzer 30.

The audio generator 5 is a device that is used to produce an audio signal. The signal that is produced is an electrical audio multitone or single tone signal that can vary in frequency and amplitude. Alternatively, the signal may be any other suitable acoustic device test signal, as one skilled in the art would know.

The external speaker 20, which is also referred to as an artificial mouth, is any speaker that is capable of receiving an audio signal and producing an acoustic audio signal. The audio signal that is received by the external speaker 20 is an electric audio signal. The electric audio signal may be digitized.

The acoustic device 25 is a device that receives and produces acoustic signals at various frequencies and strengths and volume levels. The signals produced by the acoustic device 25 are measurable with an audio analyzer 30. The signals received by the acoustic device 25 are producible by available technology such as an audio generator 5 coupled with an external speaker 20. For those skilled in the art, it is understood that the signal strength that can be produced or received is open to a range of settings. However, the exact level is not essential to the system and method described herein, and indeed the level may vary depending on the particular acoustic device. The acoustic device 25 may be a cellular telephone, a walkie-talkie, a cordless telephone or a voice recorder, for example.

The device microphone 10 is a microphone that is located in the acoustic device. The device microphone 10 is used to receive audio signals. The signals that are received by the device microphone 10 are acoustic audio signals. Alternatively, the device microphone 10 may be part of a headset, which is not shown in FIG. 1, connected to the acoustic device 25 that allows a person to use the acoustic device 25 without having to hold on to the acoustic device 25.

The auxiliary I/O device 15 is a part of the acoustic device 25 and is used as an alternative means for inputting signals to the acoustic device 25, or providing output from the acoustic device 25. The auxiliary I/O device 15 can be any electrical connection that allows the input of electrical audio signals into the device 25 from an external source or outputting of electrical audio signals from the device 25 to an external device for measurement purposes or for normal operation. For example, a device 25 may have a connector through which the acoustic device 25 can exchange electric signals like serial or other I/O communications signals with external devices, and in example embodiments such connecter can be used to implement auxiliary I/O device 15 for outputting and inputting electrical audio signals. In various example embodiments, the auxiliary I/O device 15 may be an interface plug for a headset that has both a microphone and a speaker, similar to the device microphone 10 and a device speaker. In such an embodiment, the auxiliary I/O device 15 includes electrical I/O connectors for receiving electric signals from the headset microphone and for outputting electronic signals to the headset speaker. Alternatively, the auxiliary I/O 15 device may be an input/output interface for a structure that allows the acoustic device 25 to be used while operating a car, for example. This is commonly referred to as a car kit.

The audio analyzer 30 is a device that is used to receive and analyze an audio signal. The audio analyzer 30 receives an electric audio signal and then analyzes the received signal in various fashions that may include analysis of the received signal's amplitude, frequency, harmonic distortion and other characteristics. The signal received by the audio analyzer 30 is required to be above a certain strength threshold, as one skilled in the art would understand, although the precise level is not material to the present application.

Acoustic device microphone testing begins with the production of an audio signal by the audio generator 5. The audio signal is provided as an input to an external speaker 20. The external speaker 20 may be sealed to reduce introduction of noise. The output from the external speaker 20 is provided as an input to the device microphone 10. As an output from the external speaker 20, the signal has undergone an electro-acoustic conversion such that the signal provided as an input to the device microphone 10 is an acoustic audio signal. The external speaker 20 may be connected to the device microphone 10 with a seal such that the audio signal is provided to the device microphone 10 undistorted. The audio signal provided to the device microphone 10 is then routed through the acoustic device 25 to the auxiliary I/O device 15, which serves as an output from the acoustic device 25. This routing can occur, for example, in software in the acoustic device 25. This may be accomplished by software executed by a microprocessor or some other component of the acoustic device 25. Having routed the audio signal from the device microphone 10 to the auxiliary I/O device 15, the audio signal from the auxiliary I/O device 15 is sent to the audio analyzer 30 where analyzing occurs to test the performance of the acoustic device 25. The testing may include, but is not limited to, comparing the audio signal as it is when produced by the audio generator 5 to the audio signal as it is when inputted to the audio analyzer 30, or comparing the audio signal to a predefined set of test limits for signal amplitude, frequency response, harmonic distortion or any other audio signal characteristics.

Figure 2:
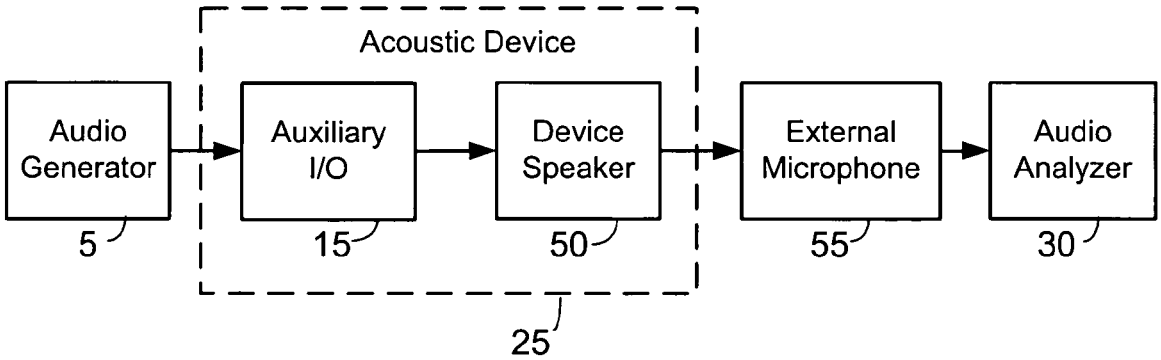
FIG. 2 is a block diagram of a system of acoustic device speaker testing.

FIG. 2 is a block diagram of a system of acoustic device speaker testing. The system includes an audio generator 5, an external microphone 55, an audio analyzer 30, and an acoustic device 25 which includes an auxiliary I/O device 15 and a device speaker 50. The audio generator 5, the auxiliary I/O device 15, the acoustic device 25, and the audio analyzer 30 are substantially the same as those described in FIG. 1.

The device speaker 50 is a component of the acoustic device 25. The device speaker 50 is used, in normal operation of the acoustic device 25, to produce acoustic signals such those used in voice conversations. The device speaker 50 can produce signals of various strengths and frequencies, although the range of these produced signal strengths and frequencies is not material to the present application. The manner in which the device speaker 50 may do this is well known to those skilled in the art.

The external microphone 55 is a microphone, which is sometimes referred to as an artificial ear. The external microphone 55 receives audio signals, which are typically acoustic audio signals, and provides the audio signals it receives to other devices or components, such as an audio analyzer 30.

Acoustic device speaker testing begins with the production of an audio signal by the audio generator 5. The audio signal that is produced by the audio generator 5 is an electric audio signal and is sent directly to the acoustic device 25 via the auxiliary I/O device 15. The audio signal provided to the auxiliary I/O device 15 is then routed through the acoustic device 25 to the device speaker 50, which serves as an output from the acoustic device 25. The routing of the audio signal through the acoustic device 25 may be accomplished, for example, in software in the acoustic device 25. This may be accomplished by software executed by a microprocessor in the acoustic device 25. Having routed the audio signal from the auxiliary I/O device 15 to the device speaker 50, the audio signal is output by the device speaker 50, undergoing an electro-acoustic conversion into an acoustic audio signal. This acoustic audio signal is then captured by the external microphone 55. The external microphone 55 then provides the audio signal, as an electric audio signal, as an input to the audio analyzer 30 where analysis occurs to test the performance of the acoustic device 25. The testing may include, but is not limited to, comparing the audio signal as it is when produced by the audio generator 5 to the audio signal as it is when inputted to the audio analyzer 30, or comparing the audio signal to a predefined set of test limits for signal amplitude, frequency response, harmonic distortion or any other audio signal characteristics.

Figure 3:
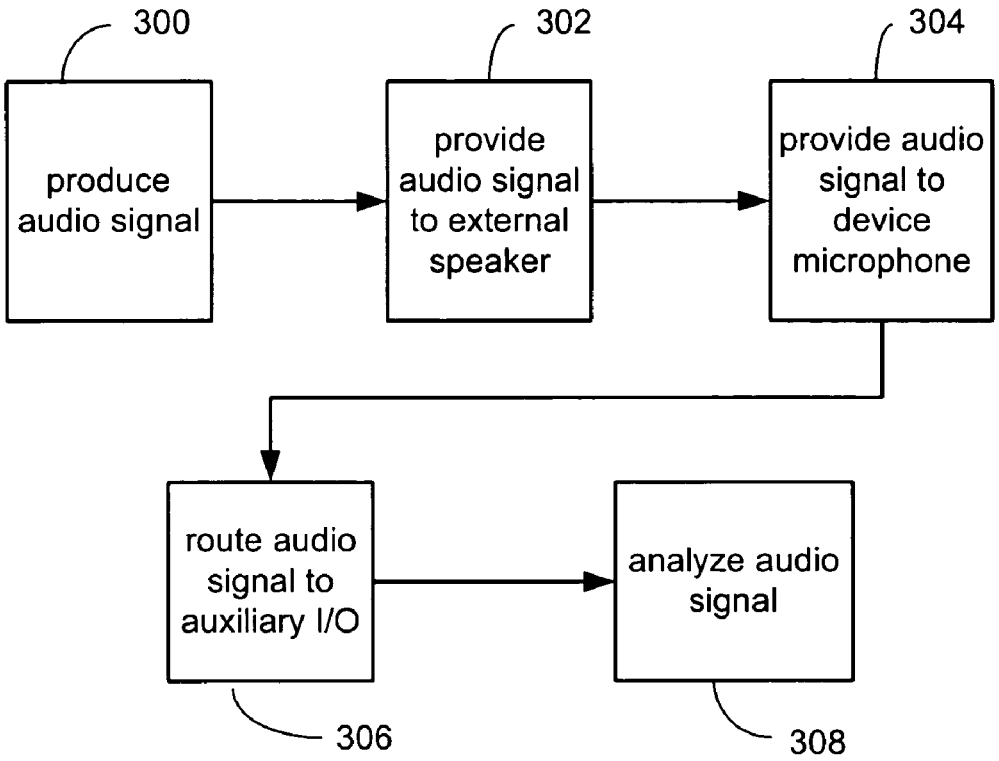
FIG. 3 is a flowchart illustrating a method of acoustic device microphone testing.

FIG. 3 is a flowchart illustrating a method of acoustic device microphone testing. The method tests the audio performance of an acoustic device comprising a device microphone and an auxiliary input/output device. The auxiliary input/output device may be a headset comprising a microphone and a speaker, or it may be a car kit, as described above.

The method beings with step 300 of producing an audio signal. The audio signal is produced by an audio generator. The audio signal may be a single tone or a multitone signal.

The method continues with step 302 of providing the audio signal produced in step 300 as input to an external speaker. The audio signal is provided as an electric audio signal.

The method continues with step 304 of providing the audio signal outputted from the external speaker as an input to the device microphone. The audio signal undergoes an electro-acoustic conversion such that the audio signal is provided as an acoustic audio signal.

The method continues with step 306 of routing the audio signal from the device microphone to the acoustic device's auxiliary input/output device. The audio signal is routed by software executed by a microprocessor which is included in the acoustic device. The audio signal is routed as an electric signal.

The method concludes with step 308 of analyzing the audio signal outputted from the auxiliary input/output device. The audio signal is an electric signal which is analyzed by an audio analyzer. The analysis may include, but is not limited to, comparing the audio signal as it is when produced by the audio generator to the audio signal as it is when inputted to the audio analyzer, or comparing the audio signal to a predefined set of test limits for signal amplitude, frequency response, harmonic distortion or any other audio signal characteristics.

Figure 4:
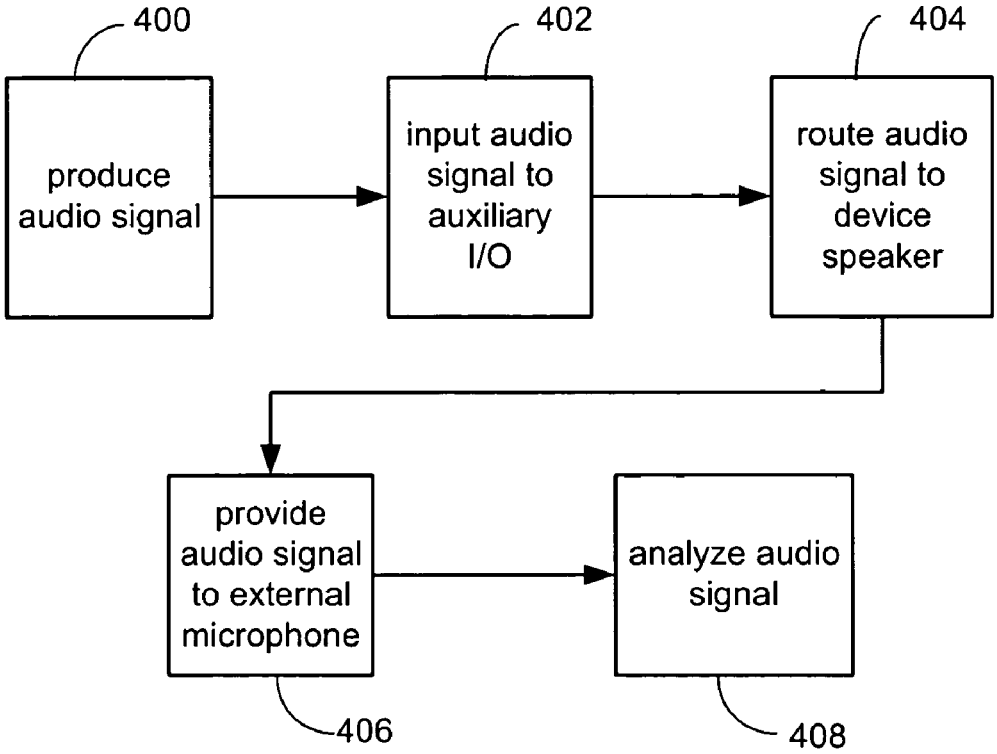
FIG. 4 is a flowchart illustrating a method of acoustic device speaker testing.

FIG. 4 is a flowchart illustrating a method of acoustic device speaker testing. The method tests the audio performance of an acoustic device comprising a device speaker and an auxiliary input/output device. The auxiliary input/output device may be a headset comprising a microphone and a speaker, or it may be a car kit, as described above.

The method beings with step 400 of producing an audio signal. The audio signal is produced by an audio generator. The audio signal may be a single tone or a multitone signal.

The method continues with step 402 of inputting the audio signal produced in step 400 to the auxiliary input/output device. The method continues with step 404 of routing the audio signal through the acoustic device from the auxiliary input/output device to the device speaker. The audio signal is routed by software executed by a microprocessor which is included in the acoustic device. The audio signal is routed as an electric signal.

The method continues with step 406 of providing the audio signal outputted from the device speaker to an external microphone. The audio signal undergoes an electro-acoustic conversion such that the audio signal is provided as an acoustic audio signal.

The method concludes with step 408 of analyzing the audio signal outputted by the external microphone. The audio signal is an electric signal which is analyzed by an audio analyzer. The analysis may include, but is not limited to, comparing the audio signal as it is when produced by the audio generator to the audio signal as it is when inputted to the audio analyzer, or comparing the audio signal to a predefined set of test limits for signal amplitude, frequency response, harmonic distortion or any other audio signal characteristics.

Figure 5:
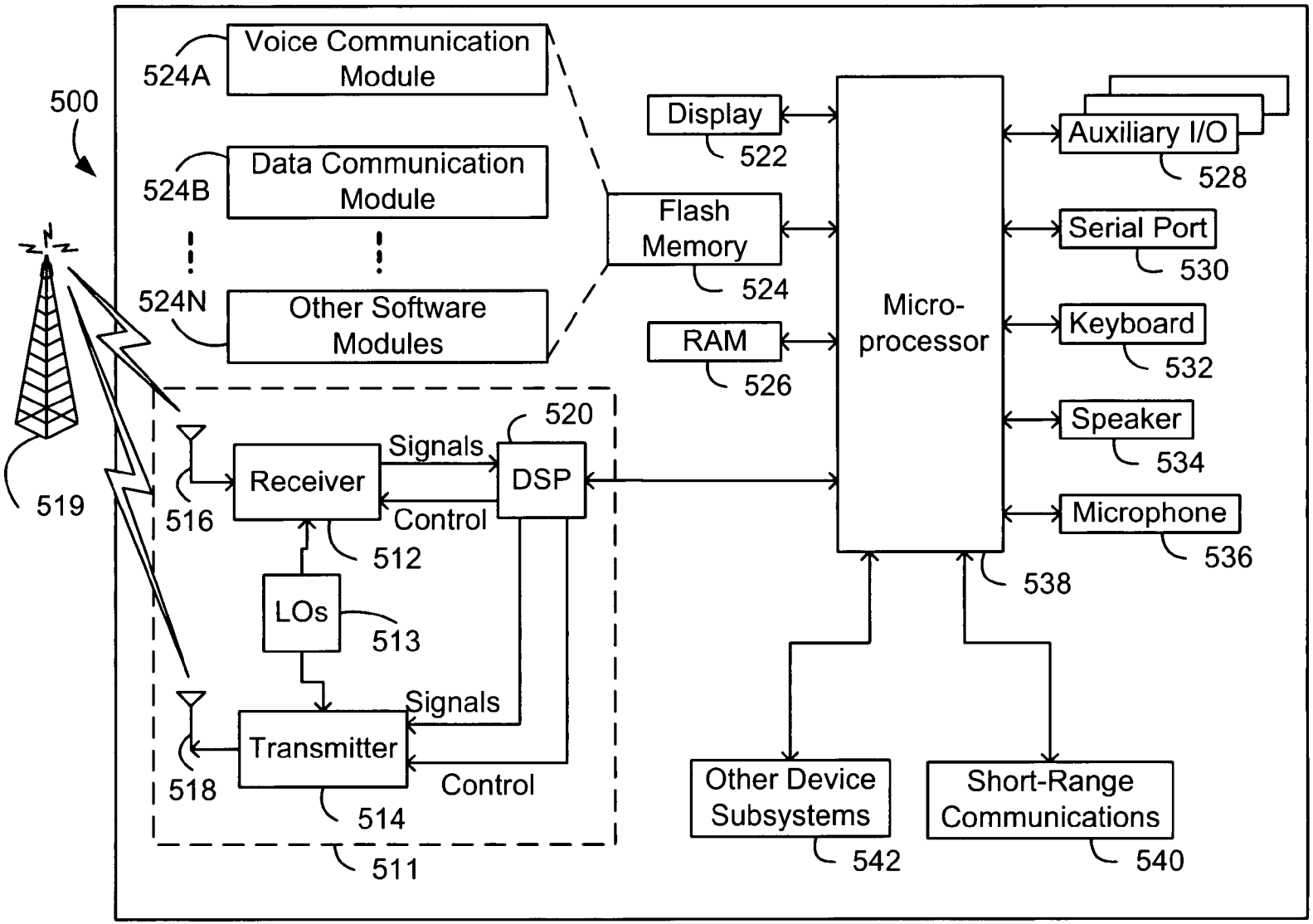
FIG. 5 is a block diagram of a dual-mode mobile communication device.

FIG. 5 is a block diagram of a dual-mode mobile communication device. The dual-mode mobile communication device 500 is an example of an acoustic device which may be tested with the systems and methods described above.

The dual-mode communication device 500 includes a transceiver 511, a microprocessor 538, a display 522, Flash memory 524, RAM memory 526, auxiliary input/output (I/O) devices 528, a serial port 530, a keyboard 532, a speaker 534, a microphone 536, a short-range wireless communications sub-system 540, and may also include other device sub-systems 542. The transceiver 511 preferably includes a transmit antenna 518, a receive antenna 516, a receiver 512, a transmitter 514, one or more local oscillators 513, and a digital signal processor 520. Within the Flash memory 524, the device 500 preferably includes a plurality of software modules 524A-524N that can be executed by the microprocessor 538 (and/or the DSP 520), including a voice communication module 524A, a data communication module 524B, and a plurality of other operational modules 524N for carrying out a plurality of other functions.

The mobile communication device 500 is preferably a two-way communication device having voice and data communication capabilities. Thus, for example, the device may communicate over a voice network, such as any of the analog or digital cellular networks, and may also communicate over a data network. The voice and data networks are depicted in FIG. 5 by the communication tower 519. These voice and data networks may be separate communication networks using separate infrastructure, such as base stations, network controllers, etc., or they may be integrated into a single wireless network.

The communication subsystem 511 is used to communicate with the voice and data network 519, and includes the receiver 512, the transmitter 514, the one or more local oscillators 513 and may also include the DSP 520. The DSP 520 is used to send and receive signals to and from the transmitter 514 and receiver 512, and is also utilized to receive control information from the transmitter 514 and to provide control information to the receiver 512. If the voice and data communications occur at a single frequency, or closely-spaced set of frequencies, then a single local oscillator 513 may be used in conjunction with the transmitter 514 and receiver 512. Alternatively, if different frequencies are utilized for voice communications versus data communications, then a plurality of local oscillators 513 can be used to generate a plurality of frequencies corresponding to the voice and data networks 519. Although two antennas 516, 518 are depicted in FIG. 5, the mobile device 500 could be used with a single antenna structure. Information, which includes both voice and data information, is communicated to and from the communication module 511 via a link between the DSP 520 and the microprocessor 538. The detailed design of the communication subsystem 511, such as frequency band, component selection, power level, etc., is dependent upon the communication network 519 in which the device is intended to operate. For example, a device 500 intended to operate in a North American market may include a communication subsystem 511 designed to operate with the Mobitex™ or DataTAC™ mobile data communication networks and also designed to operated with any of a variety of voice communication networks, such as AMPS, TDMA, CDMA, PCS, etc., whereas a device 500 intended for use in Europe may be configured to operate with the General Packet Radio Service (GPRS) data communication network and the GSM voice communication network. Other types of data and voice networks, both separate and integrated, may also be utilized with the mobile device 500.

Depending upon the type of network 519 (or networks), the access requirements for the dual-mode mobile device 500 may also vary. For example, in the Mobitex™ and DataTAC™ data networks, mobile devices are registered on the network using a unique identification number associated with each device. In GPRS data networks, however, network access is associated with a subscriber or user of a device 500. A GPRS device typically requires a subscriber identity module ("SIM"), which is required in order to operate the device 500 on a GPRS network. Local or non-network communication functions (if any) may be operable, without the SIM device, but the device 500 will be unable to carry out any functions involving communications over the data network 519, other than any legally required operations, such as 911 emergency calling.

After any required network registration or activation procedures have been completed, the dual-mode communication device 500 may then send and receive communication signals, including both voice and data signals, over the network 519 (or networks). Signals received by the antenna 516 from the communication network 519 are routed to the receiver 512, which provides for signal amplification, frequency down conversion, filtering, channel selection, etc., and may also provide analog to digital conversion. Analog to digital conversion of the received signal allows more complex communication functions, such as digital demodulation and decoding to be performed using the DSP 520. In a similar manner, signals to be transmitted to the network 519 are processed, including modulation and encoding, for example, by the DSP 520 and are then provided to the transmitter 514 for digital to analog conversion, frequency up conversion, filtering, amplification and transmission to the communication network 519 (or networks) via the antenna 518. Although a single transceiver 511 is shown in FIG. 5 for both voice and data communications, it is possible that the device 500 may include two distinct transceivers, a first transceiver for transmitting and receiving voice signals, and a second transceiver for transmitting and receiving data signals.

In addition to processing the communication signals, the DSP 520 also provides for receiver and transmitter control. For example, the gain levels applied to communication signals in the receiver 512 and transmitter 514 may be adaptively controlled through automatic gain control algorithms implemented in the DSP 520. Other transceiver control algorithms could also be implemented in the DSP 520 in order to provide more sophisticated control of the transceiver 511.

The microprocessor 538 preferably manages and controls the overall operation of the dual-mode mobile device 500. Many types of microprocessors or microcontrollers could be used here, or, alternatively, a single DSP 520 could be used to carry out the functions of the microprocessor 538. Low-level communication functions, including at least data and voice communications, are performed through the DSP 520 in the transceiver 511. Other, high-level communication applications, such as a voice communication application 524A, and a data communication application 524B may be stored in the Flash memory 524 for execution by the microprocessor 538. For example, the voice communication module 524A may provide a high-level user interface operable to transmit and receive voice calls between the dual-mode mobile device 500 and a plurality of other voice devices via the network 519. Similarly, the data communication module 524B may provide a high-level user interface operable for sending and receiving data, such as e-mail messages, files, organizer information, short text messages, etc., between the dual-mode mobile device 500 and a plurality of other data devices via the network 519. The microprocessor 538 also interacts with other device subsystems, such as the display 522, Flash memory 524, random access memory (RAM) 526, auxiliary input/output (I/O) devices or subsystems 528, serial port 530, keyboard 532, speaker 534, microphone 536, a short-range communications subsystem 540 and any other device subsystems generally designated as 542.

Some of the subsystems shown in FIG. 5 perform communication-related functions, whereas other subsystems may provide "resident" or on-device functions. Notably, some subsystems, such as keyboard 532 and display 522 may be used for both communication-related functions, such as entering a text message for transmission over a data communication network, and device-resident functions such as a calculator or task list or other PDA type functions.

Operating system software used by the microprocessor 538 is preferably stored in a persistent store such as Flash memory 524. In addition to the operation system, which controls all of the low-level functions of the device 500, the Flash memory 524 may include a plurality of high-level software application programs, or modules, such as a voice communication module 524A, a data communication module 524B, an organizer module (not shown), or any other type of software module 524N. The Flash memory 524 also may include a file system for storing data. These modules are executed by the microprocessor 538 and provide a high-level interface between a user of the device and the device. This interface typically includes a graphical component provided through the display 522, and an input/output component provided through the auxiliary I/O 528, keyboard 532, speaker 534, and microphone 536. The operating system, specific device applications or modules, or parts thereof, may be temporarily loaded into a volatile store, such as RAM 526 for faster operation. Moreover, received communication signals may also be temporarily stored to RAM 526, before permanently writing them to a file system located in the persistent store 524.

An exemplary application module 524N that may be loaded onto the dual-mode communication device 500 is a personal information manager (PIM) application providing PDA functionality, such as calendar events, appointments, and task items. This module 524N may also interact with the voice communication module 524A for managing phone calls, voice mails, etc., and may also interact with the data communication module for managing e-mail communications and other data transmissions. Alternatively, all of the functionality of the voice communication module 524A and the data communication module 524B may be integrated into the PIM module.

The Flash memory 524 preferably provides a file system to facilitate storage of PIM data items on the device. The PIM application preferably includes the ability to send and receive data items, either by itself, or in conjunction with the voice and data communication modules 524A, 524B, via the wireless network 519. The PIM data items are preferably seamlessly integrated, synchronized and updated, via the wireless network 519, with a corresponding set of data items stored or associated with a host computer system, thereby creating a mirrored system for data items associated with a particular user.

The mobile device 500 may also be manually synchronized with a host system by placing the device 500 in an interface cradle, which couples the serial port 530 of the mobile device 500 to the serial port of the host system. The serial port 530 may also be used to enable a user to set preferences through an external device or software application, or to download other application modules 524N for installation. This wired download path may be used to load an encryption key onto the device, which is a more secure method than exchanging encryption information via the wireless network 519.

Additional application modules 524N may be loaded onto the dual-mode communication device 500 through the network 519, through an auxiliary I/O subsystem 528, through the serial port 530, through the short-range communications subsystem 540, or through any other suitable subsystem 542, and installed by a user in the Flash memory 524 or RAM 526. Such flexibility in application installation increases the functionality of the device 500 and may provide enhanced on-device functions, communication-related functions, or both. For example, secure communication applications may enable electronic commerce functions and other such financial transactions to be performed using the device 500.

When the dual-mode communication device 500 is operating in a data communication mode, a received signal, such as a text message or a web page download, will be processed by the transceiver 511 and provided to the microprocessor 538, which will preferably further process the received signal for output to the display 522, or, alternatively, to an auxiliary I/O device 528. A user of dual-mode communication device 500 may also compose data items, such as email messages, using the keyboard 532, which is preferably a complete alphanumeric keyboard laid out in the QWERTY style, although other styles of complete alphanumeric keyboards such as the known DVORAK style may also be used. User input to the device 500 is further enhanced with a plurality of auxiliary I/O devices 528, which may include a thumbwheel input device, a touchpad, a variety of switches, a rocker input switch, etc. The composed data items input by the user may then be transmitted over the communication network 519 via the transceiver 511.

When the dual-mode communication device 500 is operating in a voice communication mode, the overall operation of the device 500 is substantially similar to the data mode, except that received signals are preferably be output to the speaker 534 and voice signals for transmission are generated by a microphone 536. Alternative voice or audio I/O subsystems, such as a voice message recording subsystem, may also be implemented on the device 500. Although voice or audio signal output is preferably accomplished primarily through the speaker 534, the display 522 may also be used to provide an indication of the identity of a calling party, the duration of a voice call, or other voice call related information. For example, the microprocessor 538, in conjunction with the voice communication module and the operating system software, may detect the caller identification information of an incoming voice call and display it on the display 522.

A short-range communications subsystem 540 may also be included in the dual-mode communication device 500. For example, the subsystem 540 may include an infrared device and associated circuits and components, or a Bluetooth™ short-range wireless communication module to provide for communication with similarly-enabled systems and devices.

When audio testing the dual-mode communication device 500, as described above, in at least some example embodiments the device microphone 10 (FIG. 1) is the microphone 536, the device speaker 50 (FIG. 2) is the speaker 534, and the auxiliary I/O device 15 (FIG. 1) is one of the auxiliary I/O devices 528. Audio signals are routed to and from the auxiliary I/O 528 by the voice communication application 524A.

The above description relates to one example of the present invention. Many variations will be apparent to those knowledgeable in the field, and such variations are within the scope of the application.

For example, although a dual-mode mobile communication device is provided as an example acoustic device which is tested with system and method provided, any acoustic device may be tested, including a cellular telephone, a walkie-talkie, a cordless telephone, a voice recorder, a two-way pager, or a cellular telephone with data messaging capabilities. In some example embodiments, the testing method and system may only be used to test a device microphone, in which case an output only device can be used in place of auxiliary I/O device 15, and in some example embodiments the testing method and system may only be used to test a device speaker, in which case an input only device can be used in place of auxiliary I/O device 15.

We claim:

1. A method of testing audio performance, the method comprising:

providing a two-way mobile voice-enabled communications device, the device comprising a microprocessor, a microphone connected to the microprocessor, a speaker connected to the microprocessor, an auxiliary input/output device connected to the microprocessor, a memory connected to the microprocessor, and a software module stored in the memory which configures the microprocessor to route signals from the microphone to the auxiliary input/output device;

producing a microphone electric audio test signal on an audio generator external to the two-way mobile voice-enabled communications device;

providing the microphone electric audio test signal of the audio generator as input to an external speaker;

outputting a microphone acoustic audio test signal from the external speaker corresponding to the microphone electric audio test signal;

receiving the microphone acoustic audio test signal output from the external speaker as an input to the microphone of the two-way mobile voice-enabled communications device;

outputting a microphone electric audio output signal from the microphone of the two-way mobile voice-enabled communications device corresponding to the microphone acoustic audio test signal;

directly routing the microphone electric audio output signal from the microphone to the auxiliary input/output device using the microprocessor;

outputting the microphone electric audio output signal from the auxiliary input/output device to an external test system; and analyzing the microphone electric audio output signal output from the auxiliary input/output device on the external test system.

2. The method of claim 1, wherein the microphone electric audio output signal output is compared to the microphone electric audio test signal.

3. The method of claim 1, wherein at least one signal characteristic of the microphone electric audio output signal is compared to a predefined test limit.

4. The method of claim 1, wherein a plurality of characteristics of the microphone electric audio output signal are compared to predefined test limits for a plurality of audio signal characteristics selected from the group including signal amplitude, frequency response and harmonic distortion.

5. The method of claim 1, including connecting the external speaker to the microphone of the mobile voice-enabled communications device with a seal prior to the microphone electric audio test signal being provided to the external speaker.

6. The method of claim 1, wherein the auxiliary input/output device is an electrical connector.

7. The method of claim 6, wherein the electrical connector is a headset plug through which the microphone electric audio output signal is output.

8. The method of claim 6, wherein the electrical connector is a serial port through which the microphone electric audio output signal is output.

9. The method of claim 1, wherein the microphone electric audio test signal represents a single tone signal.

10. The method of claim 1, wherein the microphone electric audio test signal represents a multitone signal.

11. The method of claim 1, wherein the mobile voice-enabled communications device comprises an RF transceiver connected to the microprocessor and wherein the mobile voice-enabled communications device is enabled for two-way wireless data communications.

12. The method of claim 1, wherein the software module configures the microprocessor to route signals from the auxiliary input/output device to the speaker, the method further comprising:

producing a speaker electric audio test signal on the audio generator external to the mobile voice-enabled communications device;

receiving the speaker electric audio test signal as input to the auxiliary input/output device from the audio generator;

directly routing the speaker electric audio test signal from the auxiliary input/output device to the speaker using the microprocessor;

outputting from the speaker a speaker acoustic audio output signal corresponding to the speaker electric audio test signal;

providing the speaker acoustic audio output signal from the speaker as input to an external microphone;

outputting a speaker electric audio output signal corresponding to the speaker acoustic audio output signal from the external microphone to the external test system; and analyzing the speaker electric audio output signal output from the external microphone on the external test system.

13. A method of testing audio performance, the method comprising:

providing a two-way mobile voice-enabled communications device, the device comprising a microprocessor, a microphone connected to the microprocessor, a speaker connected to the microprocessor, an auxiliary input/output device connected to the microprocessor, a memory connected to the microprocessor, and a software module stored in the memory which configures the microprocessor to route signals from the auxiliary input/output device to the speaker;

producing a speaker electric audio test signal on an audio generator external to the two-way mobile voice-enabled communications device;

providing the speaker electric audio test signal as input to the auxiliary input/output device from the audio generator;

directly routing the speaker electric audio test signal using the microprocessor of the mobile voice-enabled communications device from the auxiliary input/output device to the speaker;

outputting from the speaker a speaker acoustic audio output signal corresponding to the speaker test electric audio signal;

providing the speaker acoustic audio output signal from the speaker as an input to an external microphone;

outputting a speaker electric audio output signal corresponding to the speaker acoustic audio output signal from the external microphone to an external test system; and analyzing the speaker electric audio output signal output from the external microphone on the external test system.

14. The method of claim 13, wherein the speaker electric audio output signal is compared to the speaker electric audio test signal.

15. The method of claim 13, wherein at least one signal characteristic of the speaker electric audio output signal is compared to a predefined test limit.

16. The method of claim 13, wherein a plurality of characteristics of the speaker electric audio output signal are compared to predefined test limits for a plurality of audio signal characteristics selected from the group including signal amplitude, frequency response and harmonic distortion.

17. The method of claim 13, wherein the auxiliary input/output device is an electrical connector.

18. The method of claim 17, wherein the electrical connector is a headset plug to which the speaker electrical audio test signal is provided.

19. The method of claim 17, wherein the electrical connector is a serial port to which the speaker electric audio test signal is provided.

20. A system for testing the audio performance of acoustic devices, the system comprising:

an external speaker for receiving a microphone electric audio test signal as input and outputting a microphone acoustic audio test signal representation thereof; and a two-way mobile voice-enabled communications device, the device comprising a microprocessor, a microphone connected to the microprocessor, a speaker connected to the microprocessor, an auxiliary input/output device connected to the microprocessor, a memory connected to the microprocessor, and a software module stored in the memory which configures the microprocessor to route signals from the microphone to the auxiliary input/output device;

the microphone being configured to receive the microphone acoustic audio test signal output from the external speaker as input and output a microphone electric audio output signal corresponding to the microphone acoustic audio test signal;

the microprocessor under instruction of the software module being configured to:

receive a microphone electric audio output signal from the microphone; and directly route the microphone electric audio output signal to the auxiliary input/output device for output therefrom to an external test system for analysis.

21. The system of claim 20, wherein the auxiliary input/output device is an electrical connector.

22. The system of claim 20, wherein the electrical connector is a headset plug.

23. The system of claim 20, wherein the electrical connector is a serial port.

24. The system of claim 20, wherein the mobile voice-enabled communications device comprises an RF transceiver connected to the microprocessor and wherein the mobile voice-enabled communications device is enabled for two-way wireless data communications.

25. The system of claim 20, further comprising:

an audio generator coupled to the external speaker for producing the microphone electric audio test signal and providing the microphone electric audio test signal to the external speaker; and wherein the external test system is an audio analyzer coupled to the auxiliary input/output device for receiving and analyzing the microphone electric audio output signal.

26. The system of claim 20, wherein the software module configures the microprocessor to route signals from the auxiliary input/output device to the speaker, the system further comprising:

an external microphone;

wherein the microprocessor under instruction of the software module is configured to:

receive a speaker electric audio test signal via the auxiliary input/output device; and directly route the speaker electric audio test signal from the auxiliary input/output device to the speaker;

wherein the speaker is configured to receive the speaker electric audio test signal and output a speaker acoustic audio output signal representation of the speaker electric audio test signal; and wherein the external microphone is configured to receive the speaker acoustic audio output signal as input and output a speaker electric audio output signal representation thereof for analysis on the external test system.

27. A system for testing the audio performance of acoustic devices, the system comprising:

an external microphone;

a two-way mobile voice-enabled communications device, the device comprising a microprocessor, a microphone connected to the microprocessor, a speaker connected to the microprocessor, an auxiliary input/output device connected to the microprocessor, a memory connected to the microprocessor, and a software module stored in the memory which configures the microprocessor to route signals from the auxiliary input/output device to the speaker;

wherein the microprocessor under instruction of the software module is configured to:

receive a speaker electric audio test signal via the auxiliary input/output device; and directly route the speaker electric audio test signal from the auxiliary input/output device to the speaker; and wherein the speaker is configured to receive the speaker electric audio test signal and output a speaker acoustic audio output signal representation of the speaker electric audio test signal; and wherein the external microphone is configured to receive the speaker acoustic audio output signal as input and output a speaker electric audio output signal representation thereof for analysis on an external test system.

28. The system of claim 27, wherein the auxiliary input/output device is an electrical connector.

29. The system of claim 28, wherein the electrical connector is a headset plug.

30. The system of claim 28, wherein the electrical connector is a serial port.

31. The system of claim 27, wherein the mobile voice-enabled communications device comprises an RF transceiver connected to the microprocessor and wherein the mobile voice-enabled communications device is enabled for two-way wireless data communications.

32. The system of claim 27, further comprising:

an audio generator coupled to the auxiliary input/output device for producing the speaker electric audio test signal and providing the speaker electric audio test signal to the auxiliary input/output device; and wherein the external test system is an audio analyzer coupled to the external microphone for receiving and analyzing the speaker electric audio output signal.

* * * * *